US006112673A

United States Patent [19]

Gomez

[11] Patent Number: 6,112,673

[45] Date of Patent: Sep. 5, 2000

[54] PALLET ASSEMBLY FOR STORING AND TRANSPORTING DOORS AND THE LIKE

[76] Inventor: Steven V. Gomez, 5395 E. Nebraska Way, Denver, Colo. 80246

[21] Appl. No.: 09/387,977

[22] Filed: Sep. 1, 1999

[51] Int. Cl.[7] ..... B65D 19/12

[52] U.S. Cl. ..... 108/56.1; 108/51.11

[58] Field of Search ..... 108/56.1, 56.3, 108/57.2, 57.22, 51.11

[56] References Cited

U.S. PATENT DOCUMENTS

| | | | |
|---|---|---|---|
| 1,918,003 | 7/1933 | Taylor et al. | 108/56.1 |
| 3,157,423 | 11/1964 | Brie, Sr. | 108/56.1 X |
| 3,176,632 | 4/1965 | Yingling | 108/56.1 X |
| 3,355,167 | 11/1967 | Reeves | 108/56.1 X |
| 3,654,877 | 4/1972 | Barrett | 108/56.1 |
| 3,989,156 | 11/1976 | Lowry . | |
| 4,802,421 | 2/1989 | Atterby et al. | 108/56.1 X |
| 5,301,872 | 4/1994 | Tusing et al. . | |
| 5,365,859 | 11/1994 | Schrage | 108/56.1 |
| 5,562,047 | 10/1996 | Forney et al. | 108/56.1 X |
| 5,666,886 | 9/1997 | Alexander et al. . | |
| 5,809,902 | 9/1998 | Zetterberg . | |
| 5,890,437 | 4/1999 | Hill . | |

FOREIGN PATENT DOCUMENTS

| | | | |
|---|---|---|---|
| 779754 | 3/1968 | Canada | 108/56.1 |
| 1241565 | 11/1959 | France | 108/56.1 |
| 2111135 | 9/1972 | Germany | 108/56.1 |

*Primary Examiner*—Peter M. Cuomo
*Assistant Examiner*—Hanh V. Tran
*Attorney, Agent, or Firm*—Emery L. Tracy

[57] ABSTRACT

A pallet assembly capable of being assemble and disassembled is provided. The pallet assembly comprises a first rail member and a second rail member spaced from the first rail member. At least one hollow pipe member extends between the first rail member and the second rail member with a sheet member positioned on the pipe member. A rod is positioned within each pipe member and extends through the first rail member and the second rail member. A fastening mechanism is associated with each rod for releasably fastening the first rail member to the second rail member and for releasably fastening each hollow pipe member and the sheet member between the first rail member and the second rail member.

17 Claims, 4 Drawing Sheets

PALLET ASSEMBLY FOR STORING AND TRANSPORTING DOORS AND THE LIKE

BACKGROUND OF THE INVENTION

1. Field of the Invention

This invention relates generally to a pallet assembly for storing and transporting articles and the like and, more particularly, it relates to a pallet assembly for storing and transporting doors and the like which can be assembled and disassembled for easy storing and transporting.

2. Description of the Prior Art

Pallets are widely used for supporting articles and products above the ground and for transporting these articles and products from place to place. Articles and products such as consumer goods and manufactured parts are typically stored and shipped on pallets as cargo or freight. In addition, manufacturers and suppliers palletize their products by placing their product on a pallet. The pallet can then be lifted with a forklift and placed in a cargo van, track, train or any other mode of transportation suitable for cargo or freight. Alternatively, the pallet can be stored in a warehouse or bunker until being shipped at some later date. Consequently, an enormous supply of pallets is needed to meet the demands of manufacturers and suppliers who palletize their products for storage or shipment.

Most commercially available pallets are conventional hard pallets which are typically made of wood. While these wooden pallets are cumbersome and are not easily moved or stacked without assistance, these pallets are typically adapted for use with material handling equipment such as forklifts. The forklifts facilitate the transportation of articles placed on pallets from one location to another. To move a loaded pallet from place to place, the forklift is maneuvered to insert its forks into channels beneath the lower surface of the pallet. The forklift can raise the forks thereby lifting the pallet above the ground. Once the loaded pallet is above the ground, the forklift is able to transport and position the pallet in any desired location.

Alternatives to these wooden pallets such as light-weight pallets are known. The development of light-weight pallets made of plastic or other materials was brought about by the desire to make conventional pallets easier to handle. Aside from being substantially heavier than the light-weight pallets, conventional pallets are also difficult to return to their original owner once the articles have been delivered even though ideally, the accumulated empty pallets should be returned to the supplier or manufacturer for reuse. However, due to their physical size, empty conventional pallets occupy considerable amounts of space on their return trip.

Accordingly, there exists a need for a pallet assembly for storing and transporting doors and the like which can be easily assembled. Additionally, a need exists for a pallet assembly for storing and transporting doors and the like which can be easily disassembled. Furthermore, there exists a need for a pallet assembly for storing and transporting doors and the like which is durable and lasting for extended use and long life.

SUMMARY

The present invention is a pallet assembly. The pallet assembly comprises a first rail member and a second rail member spaced from the first rail member. At least one hollow pipe member extends between the first rail member and the second rail member with a sheet member positioned on the pipe member. A rod is positioned within each pipe member and extends through the first rail member and the second rail member. Fastening means are associated with each rod for releasably fastening the first rail member to the second rail member and for releasably fastening each hollow pipe member and the sheet member between the first rail member and the second rail member.

In an embodiment of the present invention, the hollow pipe member has a first end and a second end with the pallet assembly further comprising a doughnut-shaped first recessed portion formed in the first rail member and a doughnut-shaped second recessed portion formed in the second rail member. Preferably, the first end of the hollow pipe member is receivable within the first recessed portion in the first rail member and the second end of the hollow pipe member is receivable within the second recessed portion in the second rail member. Furthermore, preferably, the pallet assembly further comprises a protrusion within each of the recessed portions.

In another embodiment of the present invention, the pallet assembly further comprises an aperture through the first rail member and the second rail member, the rod extending through the aperture.

In still another embodiment of the present invention, the rod includes a first end and a threaded second end and the fastening means includes a nut threadable onto the second end of the rod.

In yet another embodiment of the present invention, the pallet assembly further comprises a plurality of strap-receiving apertures formed through the first rail member and the second rail member.

In still yet another embodiment of the present invention, the pallet assembly further comprises a pair of key-hole apertures formed through the first rail member and the second rail member.

In another embodiment of the present invention, the pallet assembly further comprises a pair of notches formed in the first rail member and the second rail member.

The present invention further includes a method for assembling a pallet assembly. The method comprises providing a first rail member and a second rail member, positioning at least one hollow pipe member between the first rail member and the second rail member, urging the second rail member toward the first rail member, and releasably securing the second rail member relative to the first rail member.

In an embodiment of the present invention the method further comprises extending a rod through the first rail member, each hollow pipe member, and the second rail member. Preferably, the method further comprises securing means associated with the rod for releasably securing the second rail member relative to the first rail member. Furthermore, preferably, the securing means is a threaded nut threadable onto a threaded end of the rod.

DETAILED DESCRIPTION OF THE PREFERRED EMBODIMENTS

Figure 1:
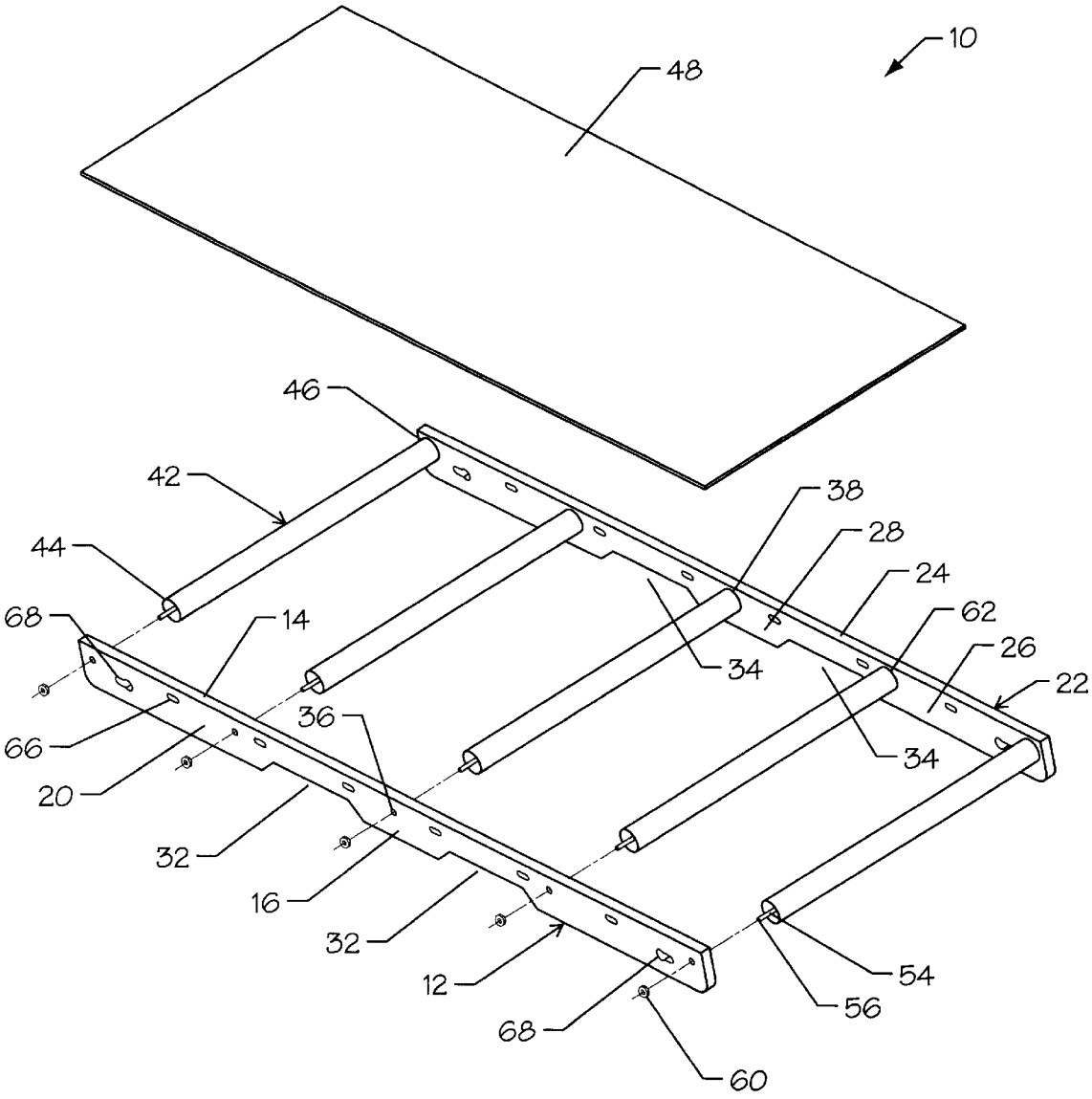
FIG. 1 is an exploded perspective view illustrating a pallet assembly for storing and transporting doors and the like, constructed in accordance with the present invention, with the pallet assembly being partially disassembled.
Figure 2:
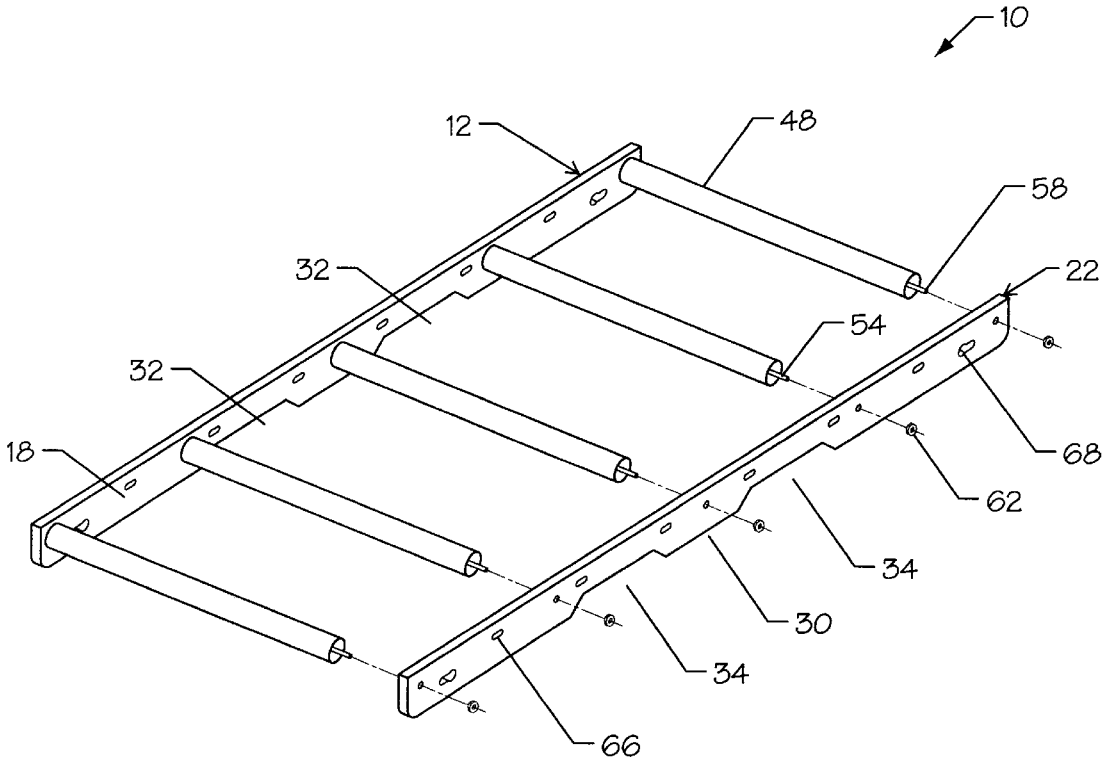
FIG. 2 is another exploded perspective view illustrating the pallet assembly for storing and transporting doors and the like as illustrated in FIG. 1, constructed in accordance with the present invention.
Figure 3:
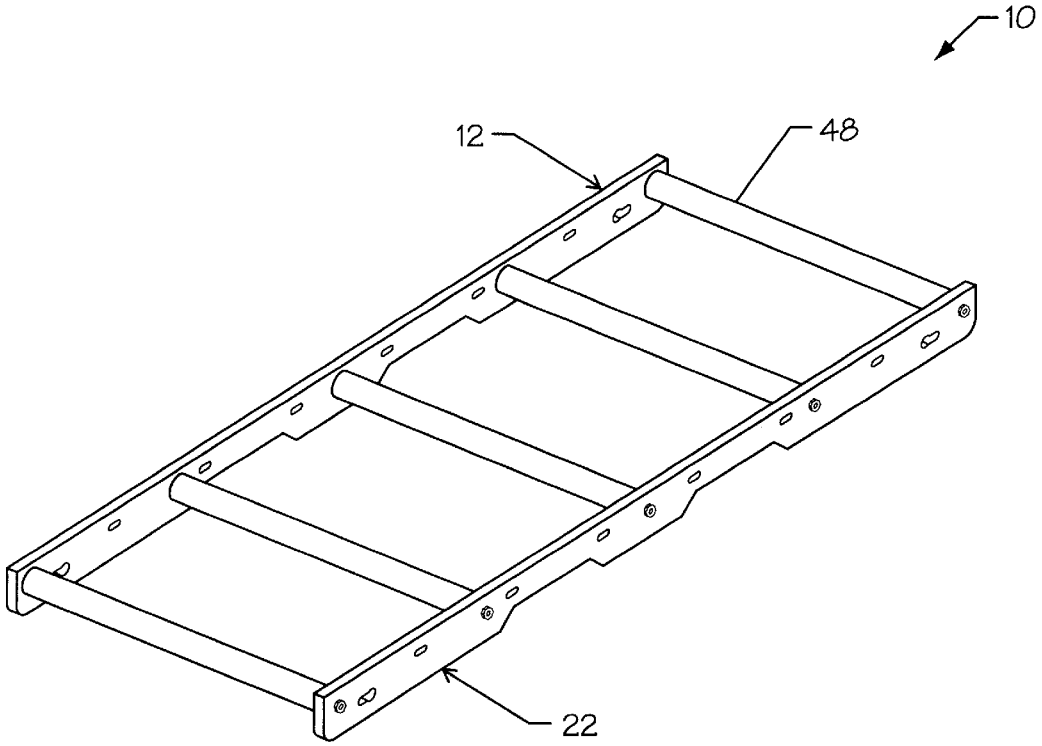
FIG. 3 is a perspective view illustrating the pallet assembly for storing and transporting doors and the like, constructed in accordance with the present invention, with the pallet assembly being assembled.
Figure 4:
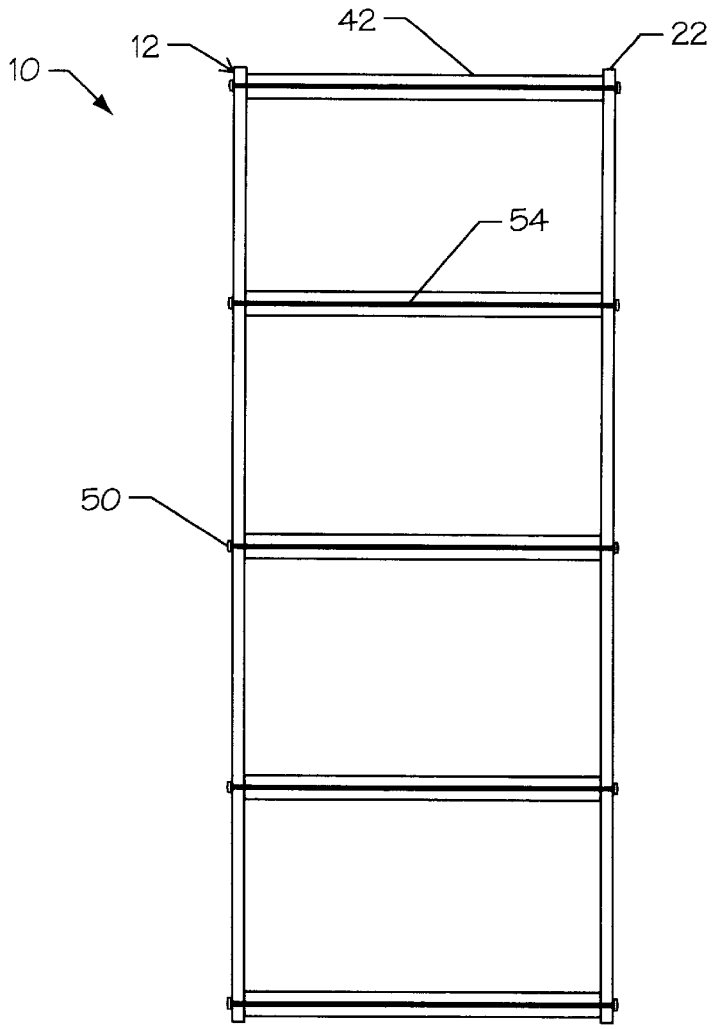
FIG. 4 is a top view illustrating the pallet assembly for storing and transporting doors and the like as illustrated in FIG. 3, constructed in accordance with the present inventions

As illustrated in FIGS. 1, 2, and 3, the present invention is a pallet assembly, indicated generally at 10, for storing and transporting doors (not shown) and the like. While the pallet assembly 10 of the present invention has been described heretofore and will described hereafter for storing and transporting doors and the like, it is within the scope of the present invention for the pallet assembly 10 to store and transport other articles and products.

The pallet assembly 10 includes a first rail member 12 having a first rail top surface 14, a first rail bottom surface 16 substantially opposite the first rail top surface 14, a first rail inside surface 18, and a first rail outside surface 20 substantially opposite the first rail inside surface 18. The pallet assembly 10 further includes a second rail member 22 having a second rail top surface 24, a second rail bottom surface 26 substantially opposite the second rail top surface 24, a second rail inside surface 28, and a second rail outside surface 30 substantially opposite the second rail inside surface 28. The first rail member 12 is positioned in a spaced apart manner from the second rail member 22 with the first rail inside surface 18 of the first rail member 12 facing the second rail inside surface 28 of the second rail member 22.

The first rail member 12 and the second rail member 22 are preferably constructed from a timber strand composite material although constructing the first rail member 12 and the second rail member 22 from other materials including, but not limited to, wood, metal, plastic, fiberglass, etc., is within the scope of the present invention. Furthermore, preferably, the first rail member 12 and the second rail member 22 have a length of approximately ninety-nine (99") inches, a height of approximately five and one-half (5½") inches, and a thickness of approximately one and one-quarter (1¼") inches. It should be noted, however, that it is within the scope of the present invention for the first rail member 12 and the second rail member 22 to have a length greater than or less than approximately ninety-nine (99") inches, a height greater than or less than approximately five and one-half (5½") inches, and a thickness greater than or less than approximately one and one-quarter (1¼") inches.

The first rail member 12 includes a pair of spaced first forklift receiving openings 32 formed in the first rail bottom surface 16 through the first rail inside surface 18 and the first rail outside surface 20 for use with material handling equipment such as forklifts (not shown). Additionally, the second rail member 22 includes a pair of spaced second rail forklift receiving openings 34 formed in the second rail bottom surface 26 through the second rail inside surface 28 and the second rail outside surface 30 for use with material handling equipment such as forklifts. Preferably, the spaced first forklift receiving openings 32 are aligned with the spaced second forklift receiving openings 34 to better accommodate the forklift or other material handling equipment.

Figure 6:
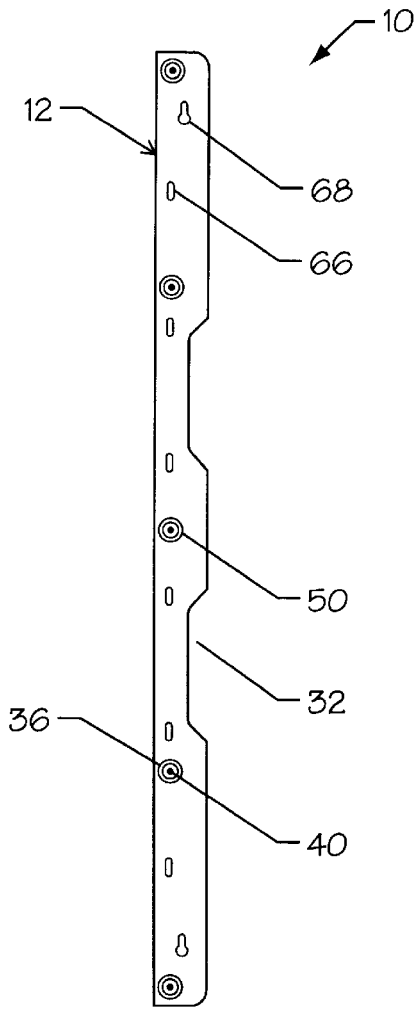
FIG. 6 is a side view illustrating the pallet assembly for storing and transporting doors and the like as illustrated in FIG. 4, constructed in accordance with the present invention.
Figure 5:
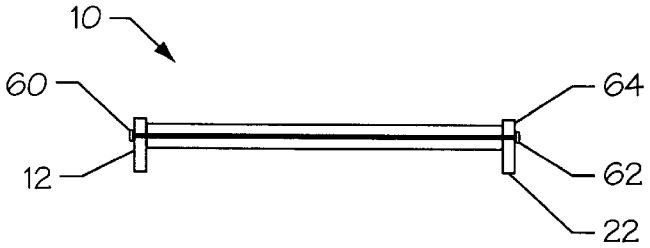
FIG. 5 is an end view illustrating the pallet assembly for storing and transporting doors and the like as illustrated in FIG. 4, constructed in accordance with the present invention.

As illustrated in FIG. 6, additionally, the first rail member 12 includes a plurality of substantially circular doughnut-shaped first recessed portions 36 spaced along the first rail member 12 and formed in the first rail inside surface 18 and the second rail member 22 includes a plurality of corresponding substantially circular doughnut-shaped second recessed portion 38 spaced along the second rail member 22 and formed in the second rail inside surface 28. Preferably, each of the first recessed portions 36 is aligned with a corresponding second recessed portion 38. A rod supporting portion 40 of the first rail member 12 and the second rail member 22 remains within the first recessed portion 36 and the second recessed portion 38, respectively.

Referring back to FIGS. 1–6, the pallet assembly 10 of the present invention II further includes at least one hollow pipe member 42 for supporting loads upon the assembled pallet assembly 10. Each hollow pipe member 42 includes a first pipe end 44 and a second pipe end 46 with each first pipe end 44 releasably mounted within each of the first recessed portions 36 and each second pipe end 46 releasably mounted with the corresponding second recessed portion 38 between the first rail inside surface 18 of the first rail member 12 and the second rail inside surface 28 of the second rail member 22. Preferably, the hollow pipe member 42 has a diameter of approximately two and one-half (2-½") inches although a hollow pipe member 42 having a diameter greater than or less than two and one-half (2½") inches is within the scope of the present invention. When mounted within the first recessed portion 36 and the second recessed portion 38, the first pipe end 44 and the second pipe end 46 of the hollow pipe member 42 substantially surround the rod supporting portion 40 within the first recessed portion 36 and the second recessed portion 38, respectively. Preferably, the pallet assembly 10 of the present invention includes five (5) hollow pipe members 42 spaced along the length of the first rail member 12 and the second rail member 22.

The pallet assembly 10 of the present invention further includes a sheet member 48 of OSB-type material releasably positioned upon and substantially supported by the hollow pipe members 42 for placement of the doors and the like thereon. Preferably, the sheet member 48 has a length of approximately ninety nine (99") inches although a sheet member 48 having a length greater than or less than approximately ninety nine (99") inches. The sheet member 48 is releasably secured upon the hollow pipe members 42 between the first rail member 12 and the second rail member 22, as will be described further below. While the sheet member 48 has been described as being an OSB material, it is within the scope of the present invention to have the sheet member 48 being constructed of plywood, metal, plastic, fiberglass, etc.

The first rail member 12 further includes a plurality of first rod receiving openings 50 formed within the rod supporting portions 40 of the first rail member 12. In addition, the second rail member 22 further includes a plurality of second rod receiving openings 52 formed within the rod supporting portions 40 of the second rail member 22. A rod 54 having a first end 56 and a threaded second end 58 is inserted through the first rod receiving opening 50 of the first rail member 12, extends through the hollow pipe member 42, and extends through the second rod receiving opening 52 of the second rail member 22. The rod 54 preferably has a diameter of approximately one-quarter (¼") inch although having a rod 54 with a diameter greater than or less than approximately one-quarter (¼") inch is within the scope of the present invention.

The first end 56 of the rod 54 is releasably secured between the first rail member 12 and the second rail member 22 by a fixed nut 60 or the like welded to the first end 56 of the rod 54 adjacent the first rail outside surface 20. A corresponding threaded nut 62 with at least one corresponding washer 64 is releasably secured to the threaded second end 58 of the rod 54 adjacent the second rail outside surface 30. The tightening of the threaded nut 62 allows the second rail member 22 to be urged toward the first rail member 12 thereby releasably securing the hollow pipe member 42 within the first recessed portion 36 and the second recessed portion 38 and the sheet member 48 to be releasably secured between the first rail inside surface 18 of the first rail member 12 and the second rail inside surface 28 of the second rail member 22.

The pallet assembly 10 of the present invention includes a plurality of slotted apertures 66 formed through the first rail member 12 and the second rail member 22 for receiving strapping (not shown) or bands (not shown). The strapping or bands extend through the slotted apertures 66 and over the doors and the like positioned on the sheet member 48 and releasably and securely maintain the doors and the like on the pallet assembly 10 during storage and transporting.

Additionally, the pallet assembly 10 of the present invention includes at least one key-shaped aperture 68 formed through the first rail member 12 and the second rail member 22 for receiving a chain or the like; namely, preferably, at least one key-shaped aperture 68 is located at each end of the first rail member 12 and at each end of the second rail member 22. The key-shaped aperture 68 allows the chain to be inserted therein for assisting workers in moving the pallet assembly 10 from a truck or other delivery vehicle. The assembly and disassembly of the pallet assembly 10 of the present invention will now be described. A person skilled in the art will realize and understand that there are numerous ways to assemble and disassemble the pallet assembly 10. A preferred embodiment of assembly and disassembly of the pallet assembly 10 will now be described.

First, the first rail member 12 and the second rail member 22 are positioned in a spaced-apart manner with the first rail bottom surface 16 of the first rail member 12 and the second rail bottom surface 26 of the second rail member 22 being positioned on a substantially flat surface (not shown) and the first rail inside surface 18 of the first rail member 12 facing the second rail inside surface 28 of the second rail member 22. Next, the first pipe end 44 of the hollow pipe members 42 is positioned within the first recessed portion 36 of the first rail member 12 and the second pipe end 46 of the hollow pipe members 42 is positioned with the second recessed portions 38 of the second rail member 22. The sheet member 48 is then positioned upon the hollow pipe members 42. Finally, the rods 54 are inserted into each first rod receiving opening 50 of the first rail member 12, through each hollow pipe member 42, and into each second rod receiving opening 52 of the second rail member 22 with the threaded nut 62 being tightened on each second rod end 58 of the rod. The first rail member 12, the second rail member 22, rods 54, the hollow pipe members 42, and the sheet members 48 are thereby releasably secured to form the assembled pallet assembly 10.

To disassemble the pallet assembly 10 of the present invention, the threaded nut 62 is loosened and removed from the second end 58 of the rod 54. The rod 54 is then removed and the remainder of the pallet assembly 10 can be disassembled. The disassembled pallet assembly 10 of the present invention can then be easily stored or transported in a compact and efficient manner. In its final assembled configuration, the pallet assembly 10 has a length of approximately ninety-nine (99") inches and a width of approximately thirty-nine (39") inches. The inventor of the present application have determined this size of pallet assembly 10 to be the best size for storing and transporting doors. A person skilled in the art will understand and realize that the assembled pallet assembly 10 of the present invention can be constructed to have a length greater than or less than approximately ninety-nine (99") inches and a width greater than or less than approximately thirty-nine (39") inches depending on the articles or products being stored or transported.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. A pallet assembly, the pallet assembly comprising:

a first rail member;

a second rail member spaced from the first rail member;

at least one hollow pipe member extending between the first rail member and the second rail member;

a sheet member positioned on the pipe member, the sheet member being releasably secured between the first rail member and the second rail member;

a rod positioned within said pipe member and extending through the first rail member and the second rail member; and fastening means associated with said rod for releasably fastening the first rail member to the second rail member, for releasably maintaining the rod within said pipe member, and for releasably fastening said hollow pipe member and the sheet member between the first rail member and the second rail member.

2. The pallet assembly of claim 1 wherein the hollow pipe member has a first end and a second end, and further comprising a doughnut-shaped first recessed portion formed in the first rail member and a doughnut-shaped second recessed portion formed in the second rail member, the first end of the hollow pipe member receivable within the first recessed portion in the first rail member and the second end of the hollow pipe member receivable within the second recessed portion in the second rail member.

3. The pallet assembly of claim 2 and further comprising:

a protrusion within each of the recessed portions.

4. The pallet assembly of claim 1 and further comprising:

an aperture through the first rail member and the second rail member, the rod extending through the aperture.

5. The pallet assembly of claim 1 wherein the rod includes a first end and a threaded second end, the fastening means including a nut threadable onto the second end of the rod.

6. The pallet assembly of claim 1 and further comprising:

a plurality of strap-receiving apertures formed through the first rail member and the second rail member.

7. The pallet assembly of claim 1 and further comprising:

a pair of key-hole apertures formed through the first rail member and the second rail member.

8. The pallet assembly of claim 1 and further comprising:

a pair of notches formed in the first rail member and the second rail member.

9. The pallet assembly of claim 1 and further comprising:

five hollow pipe members.

10. The pallet assembly of claim 1 and further comprising:

five rods.

11. A pallet assembly, the pallet assembly comprising:

first rail means;

second rail means;

supporting means releasably securable between the first rail means and the second rail means; and a sheet member being releasably secured between the first rail means and the second rail means;

securing means extending through the supporting means and the first rail means and the second rail means for releasably securing the first rail means to the second rail means and releasably securing the supporting means between the first rail means and the second rail means.

12. The pallet assembly of claim 11 wherein the supporting means includes at least one hollow pipe member.

13. The pallet assembly of claim 11 wherein the securing means includes a rod.

14. The pallet assembly of claim 13 and further comprising:

means for securing the rod to the first rail means and the second rail means.

15. A method for assembling a pallet assembly, the method comprising:

providing a first rail member and a second rail member;

positioning at least one hollow pipe member and a sheet member between the first rail member and the second rail member;

extending a rod through the first rail member, said hollow pipe member, and the second rail member;

providing securing means associated with said rod for releasably securing the second rail member relative to the first rail member and for releasably securing the sheet member between the first member and the second rail member.

16. The method of claim 15 wherein the securing means is a threaded nut threadable onto a threaded end of the rod.

17. The method of claim 15 and further comprising:

five hollow pipe members.

* * * * *